US010955141B2

(12) United States Patent
Graham et al.

(10) Patent No.: US 10,955,141 B2
(45) Date of Patent: Mar. 23, 2021

(54) DUAL-FUEL FUEL NOZZLE WITH GAS AND LIQUID FUEL CAPABILITY

(71) Applicant: General Electric Company, Schenectady, NY (US)

(72) Inventors: Kaitlin Marie Graham, Greenville, SC (US); Thomas Edward Johnson, Greer, SC (US); Geoffrey David Myers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 337 days.

(21) Appl. No.: 15/626,387

(22) Filed: Jun. 19, 2017

(65) Prior Publication Data

US 2018/0363911 A1 Dec. 20, 2018

(51) Int. Cl.

| | |
|---|---|
| ***F23R 3/36*** | (2006.01) |
| ***F23R 3/28*** | (2006.01) |
| ***F23D 17/00*** | (2006.01) |

(52) U.S. Cl.

CPC ..... *F23R 3/36* (2013.01); *F23D 17/002* (2013.01); *F23R 3/283* (2013.01); *F23R 3/286* (2013.01)

(58) Field of Classification Search

CPC .. F23R 3/283; F23R 3/286; F23R 3/36; F23D 14/62; F23D 14/64; F23D 17/002; F23D 11/40; F05D 2250/25

See application file for complete search history.

(56) References Cited

U.S. PATENT DOCUMENTS

| | | | | |
|---|---|---|---|---|
| 2,786,331 | A | 3/1957 | Williams | |
| 4,258,544 | A * | 3/1981 | Gebhart | F02C 7/222 60/742 |
| 4,815,664 | A | 3/1989 | Tuthill et al. | |
| 5,408,830 | A | 4/1995 | Lovett | |
| 5,813,847 | A | 9/1998 | Eroglu et al. | |
| 6,076,356 | A | 6/2000 | Pelletier | |
| 6,178,752 | B1 | 1/2001 | Morford | |
| 6,311,473 | B1 | 11/2001 | Benjamin et al. | |
| 6,446,439 | B1 * | 9/2002 | Kraft | F23R 3/286 60/739 |
| 6,523,350 | B1 | 2/2003 | Mancini et al. | |

(Continued)

FOREIGN PATENT DOCUMENTS

WO WO2017034435 A1 3/2017

*Primary Examiner* — Arun Goyal
*Assistant Examiner* — David P. Olynick
(74) *Attorney, Agent, or Firm* — Dority & Manning, P.A.

(57) ABSTRACT

The present disclosure is directed to a fuel nozzle including a center body having a tube shape and a ring manifold disposed at an aft end of the center body. The fuel nozzle also includes an inner tube extending axially through the ring manifold and disposed within the center body. The inner tube is in fluid communication with a diluent supply. The fuel nozzle further includes a fuel tube extending helically around a portion of the inner tube. The fuel tube fluidly couples a fuel plenum of the ring manifold to a liquid fuel supply. Furthermore, the fuel nozzle includes a plurality of fuel injectors circumferentially spaced within an outer band of the ring manifold and in fluid communication with the fuel plenum. Each fuel injector is oriented to direct atomized liquid fuel radially outward from the center body. The ring manifold and the inner tube are thermally decoupled.

16 Claims, 6 Drawing Sheets

(56) References Cited

U.S. PATENT DOCUMENTS

| | | | | |
|---|---|---|---|---|
| 6,655,145 | B2 | 12/2003 | Boardman | |
| 7,377,036 | B2 * | 5/2008 | Johnson | F23R 3/286 29/401.1 |
| 7,703,287 | B2 | 4/2010 | Haggerty et al. | |
| 7,900,456 | B2 * | 3/2011 | Mao | F23D 11/107 60/740 |
| 8,281,595 | B2 | 10/2012 | Davis, Jr. et al. | |
| 8,418,469 | B2 | 4/2013 | Myers et al. | |
| 9,010,119 | B2 | 4/2015 | Myers | |
| 9,217,570 | B2 | 12/2015 | Parsania et al. | |
| 9,546,600 | B2 | 1/2017 | Cihlar et al. | |
| 9,739,202 | B2 * | 8/2017 | Vetters | F02C 7/222 |
| 2009/0111063 | A1 | 4/2009 | Boardman et al. | |
| 2009/0218421 | A1 | 9/2009 | Kumaravelu | |
| 2009/0293482 | A1 * | 12/2009 | Davis, Jr. | F23D 14/82 60/737 |
| 2010/0205970 | A1 * | 8/2010 | Hessler | F23R 3/343 60/734 |
| 2012/0073302 | A1 * | 3/2012 | Myers | F23D 11/402 60/748 |
| 2013/0122434 | A1 * | 5/2013 | Stoia | F23R 3/283 431/12 |
| 2013/0283798 | A1 * | 10/2013 | Bellino | F23R 3/286 60/722 |
| 2014/0116054 | A1 * | 5/2014 | Means | F23R 3/283 60/739 |
| 2016/0146460 | A1 * | 5/2016 | Stewart | F23D 17/00 60/737 |
| 2016/0169110 | A1 | 6/2016 | Myers et al. | |
| 2016/0258628 | A1 * | 9/2016 | Ginessin | F23D 11/36 |
| 2016/0348911 | A1 * | 12/2016 | Polyzopoulos | F23R 3/06 |

* cited by examiner

DUAL-FUEL FUEL NOZZLE WITH GAS AND LIQUID FUEL CAPABILITY

TECHNICAL FIELD

The subject matter disclosed herein relates to a fuel nozzle for a combustion system. More particularly, the disclosure is directed to a dual-fuel fuel nozzle.

BACKGROUND

Gas turbines generally operate by combusting a fuel and air mixture in one or more combustors to create a high-energy combustion gas that passes through a turbine, thereby causing a turbine rotor shaft to rotate. The rotational energy of the rotor shaft may be converted to electrical energy via a generator coupled to the rotor shaft. Each combustor generally includes fuel nozzles that provide for delivery of the fuel and air upstream of a combustion zone, using premixing of the fuel and air as a means to keep nitrogen oxide (NOx) emissions low.

Gaseous fuels, such as natural gas, often are employed as a combustible fluid in gas turbine engines used to generate electricity. In some instances, it may be desirable for the combustion system to be able to combust liquid fuels, such as distillate oil. A configuration with both gas and liquid fuel capability is called a "dual-fuel" combustion system. Certain combustion systems operate using multiple dual-fuel outer nozzles annularly arranged around a center fuel nozzle. In legacy systems, secondary or liquid fuel is supplied to the outer dual-fuel nozzles only to provide a diffusion flame. The diffusion flame provided by each of the outer dual-fuel nozzles helps to keep combustion dynamics tones low or within a desirable range. However, as the outer fuel nozzles are transitioned from diffusion mode to premixed mode, it is necessary to have an anchor flame to control and/or to mitigate combustor dynamics.

BRIEF DESCRIPTION

Aspects and advantages are set forth below in the following description, or may be obvious from the description, or may be learned through practice.

In one embodiment, the present disclosure is directed to a fuel nozzle. The fuel nozzle includes a center body having a tube shape and a ring manifold disposed at an aft end of the center body. The fuel nozzle also includes an inner tube extending axially through the ring manifold and disposed within the center body. The inner tube is in fluid communication with a diluent supply. The fuel nozzle further includes a fuel tube extending helically around a portion of the inner tube. The fuel tube fluidly couples a fuel plenum of the ring manifold to a liquid fuel supply. Furthermore, the fuel nozzle includes a plurality of fuel injectors circumferentially spaced within an outer band of the ring manifold and in fluid communication with the fuel plenum. Each fuel injector of the plurality of fuel injectors is oriented to direct a flow of atomized liquid fuel radially outward from the center body. The ring manifold and the inner tube are thermally decoupled.

In another embodiment, the present disclosure is directed to a combustor. The combustor includes an end cover and a plurality of dual-fuel primary fuel nozzles connected to the end cover and annularly arranged around a center fuel nozzle. The center fuel nozzle includes a center body having a tube shape and a ring manifold disposed at an aft end of the center body. The center fuel nozzle also includes an inner tube extending axially through the ring manifold and disposed within the center body. The inner tube is in fluid communication with a diluent supply. The center fuel nozzle further includes a fuel tube extending helically around a portion of the inner tube. The fuel tube fluidly couples a fuel plenum of the ring manifold to a liquid fuel supply. Furthermore, the center fuel nozzle includes a plurality of fuel injectors circumferentially spaced within an outer band of the ring manifold and in fluid communication with the fuel plenum. Each fuel injector of the plurality of fuel injectors is oriented to direct a flow of atomized liquid fuel radially outward from the center body. The ring manifold and the inner tube are thermally decoupled.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode of practicing the various embodiments, is set forth more particularly in the remainder of the specification, including reference to the accompanying figures, in which.

DETAILED DESCRIPTION

Figure 1:
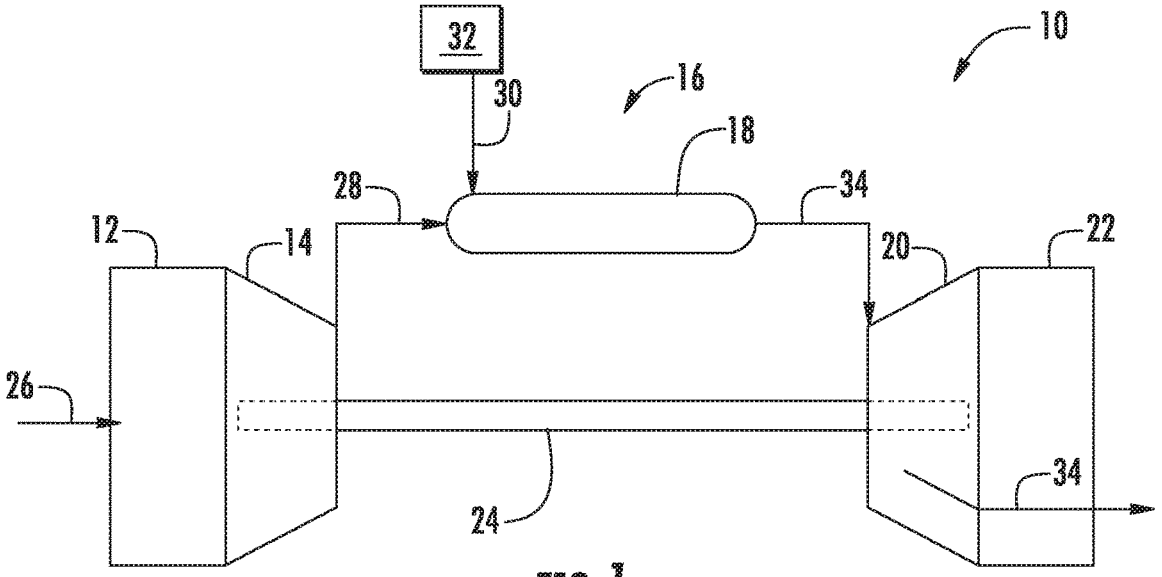
FIG. 1 is a functional block diagram of an exemplary gas turbine as may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a fuel nozzle for a land-based power-generating gas turbine combustor for purposes of illustration, one of ordinary skill in the art will readily appreciate that embodiments of the present disclosure may be applied to any style or type of combustor for a turbomachine and are not limited to combustors or combustion systems for land-based power-generating gas turbines unless specifically recited in the claims.

Referring now to the drawings, FIG. 1 provides a schematic diagram of an exemplary gas turbine 10. The gas turbine 10 generally includes an inlet section 12, a compressor 14 disposed downstream of the inlet section 12, a combustion system 16 including at least one combustor 18 disposed downstream of the compressor 14, a turbine 20 disposed downstream of the combustor 18 and an exhaust section 22 disposed downstream of the turbine 20. Additionally, the gas turbine 10 may include one or more shafts 24 that couple the compressor 14 to the turbine 20.

During operation, air 26 flows through the inlet section 12 and into the compressor 14 where the air 26 is progressively compressed, thus providing compressed air 28 to the combustor 18. A fuel 30 from a fuel supply 32 is injected into the combustor 18, mixed with a portion of the compressed air 28 and burned to produce combustion gases 34. The combustion gases 34 flow from the combustor 18 into the turbine 20, wherein energy (kinetic and/or thermal) is transferred from the combustion gases 34 to rotor blades (not shown), thus causing shaft 24 to rotate. The mechanical rotational energy may then be used for various purposes such as to power the compressor 14 and/or to generate electricity. The combustion gases 34 exiting the turbine 20 may then be exhausted from the gas turbine 10 via the exhaust section 22.

Figure 2:
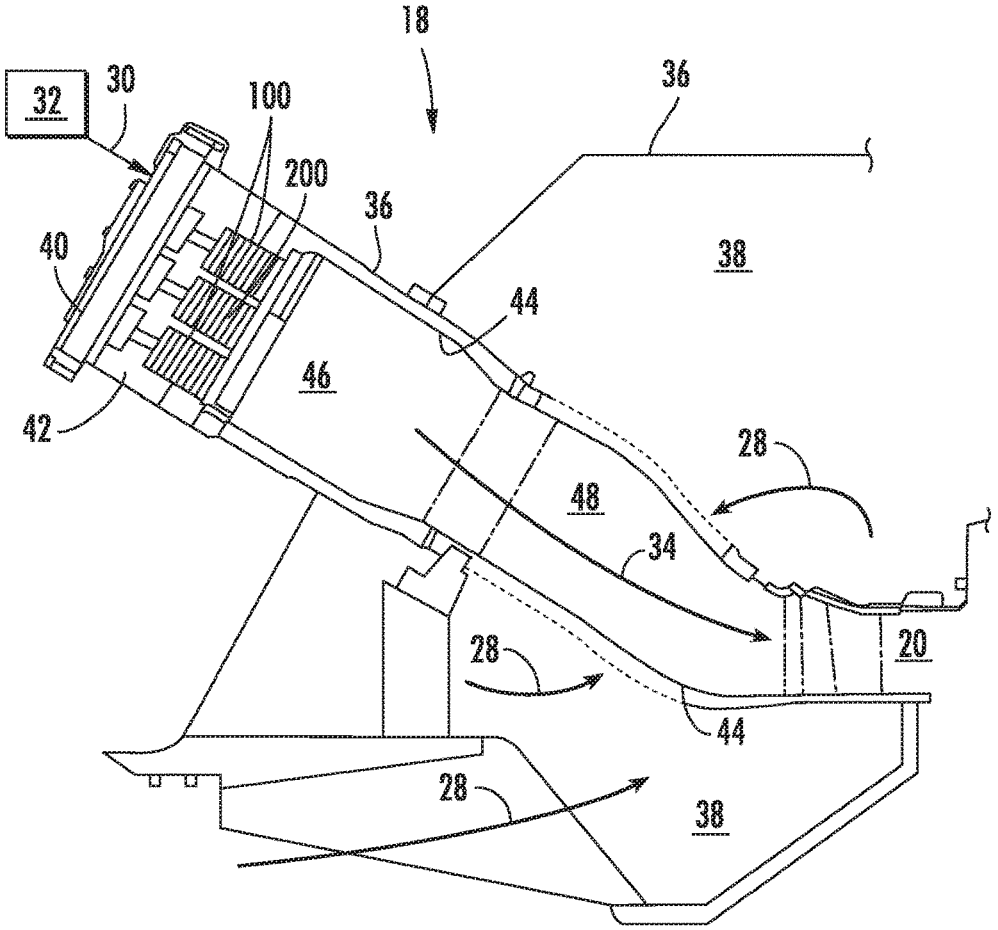
FIG. 2 is a simplified cross-section side view of an exemplary combustor as may incorporate various embodiments of the present disclosure.

FIG. 2 provides a cross-sectioned schematic of an exemplary combustor 18 as may incorporate various embodiments of the present disclosure. As shown in FIG. 2, the combustor 18 may be at least partially surrounded by an outer casing 36 such as a compressor discharge casing. The outer casing 36 may at least partially define a high pressure plenum 38 that at least partially surrounds various components of the combustor 18. The high pressure plenum 38 may be in fluid communication with the compressor 14 (FIG. 1) to receive at least a portion of the compressed air 28 therefrom.

An end cover 40 may be coupled to the outer casing 36. In particular embodiments, the outer casing 36 and the end cover 40 may at least partially define a head end volume or chamber 42 of the combustor 18. In particular embodiments, the head end volume 42 is in fluid communication with the high pressure plenum 38 and the compressor 14. One or more liners or ducts 44 may at least partially define a combustion chamber or zone 46 for combusting the fuel-air mixture and may at least partially define a hot gas path 48 through the combustor 18 for directing the combustion gases 34 towards an inlet to the turbine 20.

Figure 3:
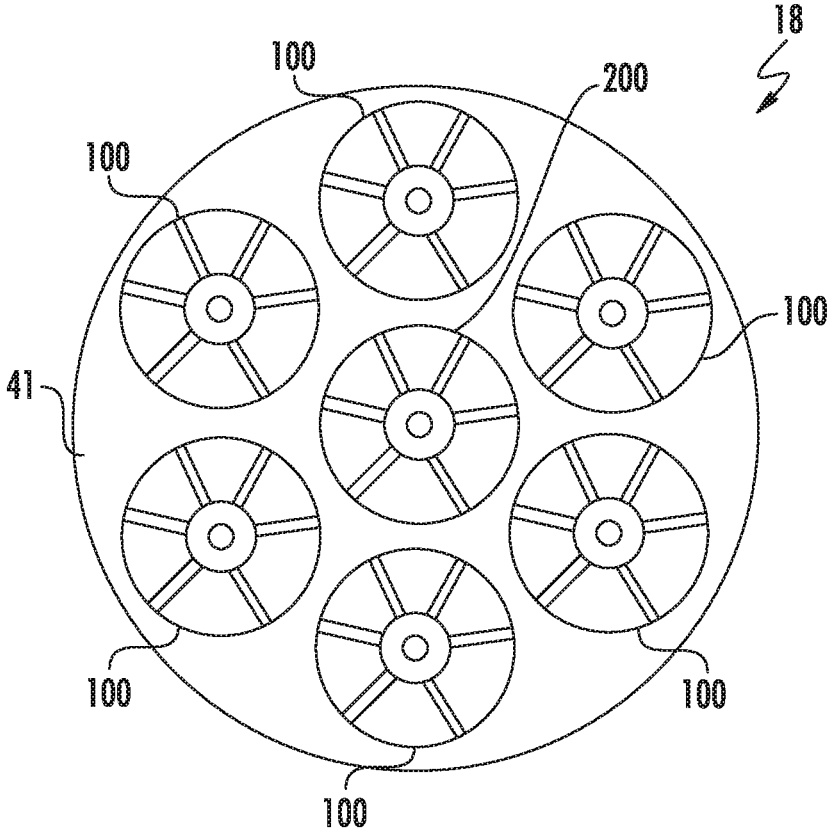
FIG. 3 is an upstream view of an exemplary cap assembly as may incorporate various embodiment of the present disclosure.

FIG. 3 provides an upstream view of a portion of the combustor 18 shown in FIG. 2. In various embodiments, as shown in FIGS. 2 and 3 collectively, the combustor 18 includes multiple fuel nozzles (e.g., 100) whose upstream ends are coupled to the end cover 40 and which extend toward the combustion chamber 46. The downstream ends of the fuel nozzles (e.g., 100) are aligned with respective openings (not shown) in a cap assembly 41, such that the fuel nozzles (e.g., 100) deliver fuel through the cap assembly 41 to the combustion chamber 46.

Various embodiments of the combustor 18 may include different numbers and arrangements of fuel nozzles, and the presently described embodiments are not limited to any particular number of fuel nozzles unless otherwise specified in the claims. For example, in a particular configuration shown in FIG. 3, the one or more fuel nozzles includes multiple primary (or outer) fuel nozzles 100 annularly arranged about a center (or central) fuel nozzle 200. The downstream ends of the fuel nozzles (e.g., 100) are aligned with respective openings (not shown) in a cap assembly 41, such that the fuel nozzles (e.g., 100) deliver fuel through the cap assembly 41 to the combustion chamber 46.

In particular embodiments, the center fuel nozzle 200 is a pre-mix, dual-fuel (liquid fuel and gas fuel) type fuel nozzle. In particular embodiments, each outer fuel nozzle is also a pre-mix, dual-fuel type fuel nozzle. Each pre-mix, dual-fuel fuel nozzle 100, 200 is configured to inject and premix a gaseous fuel and/or a liquid fuel with a flow of a portion of the compressed air 28 from the head end volume 42 upstream from the combustion zone 46. Other types of fuel nozzles may be used instead of the outer fuel nozzles 100 or the center fuel nozzle 200, as needs dictate.

Figure 4:
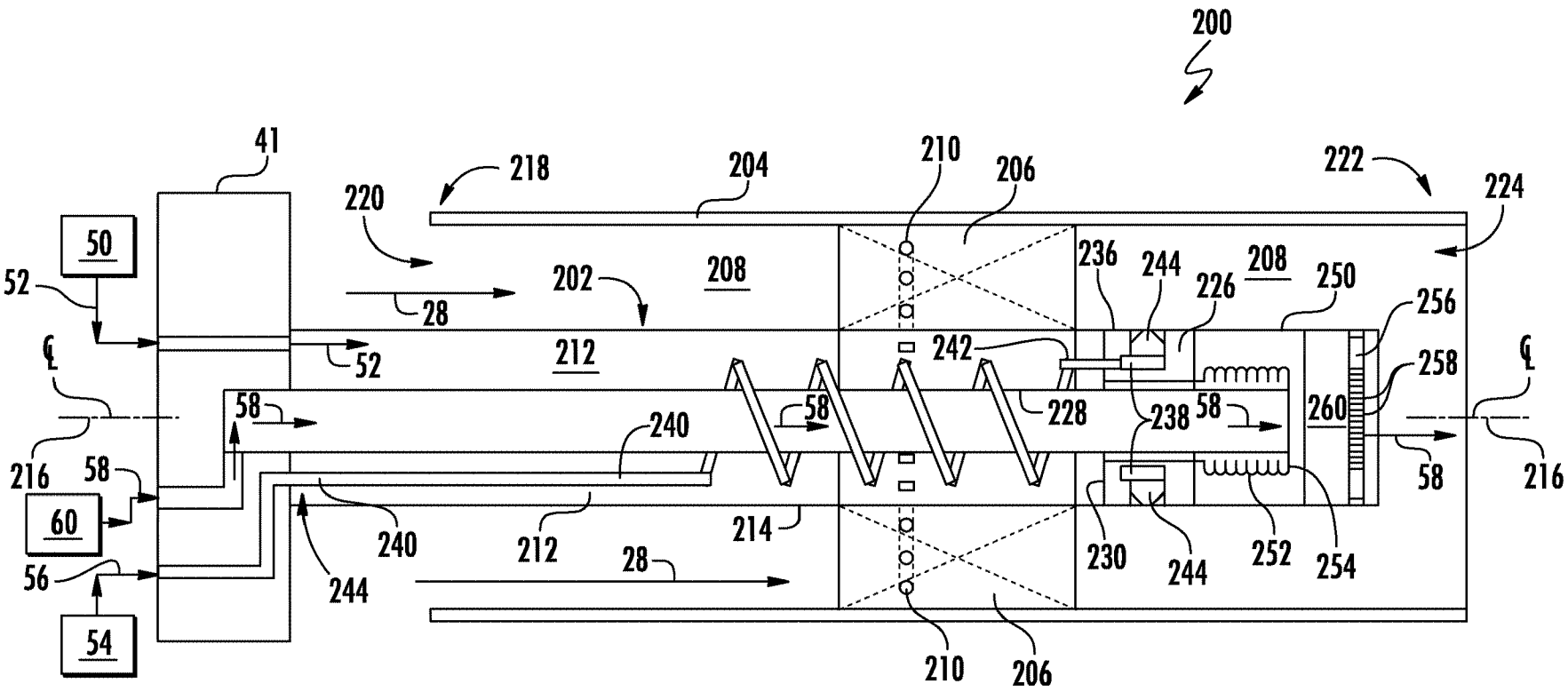
FIG. 4 is a cross-sectioned side view of an exemplary center fuel nozzle as may incorporate one or more embodiments of the present disclosure.
Figure 5:
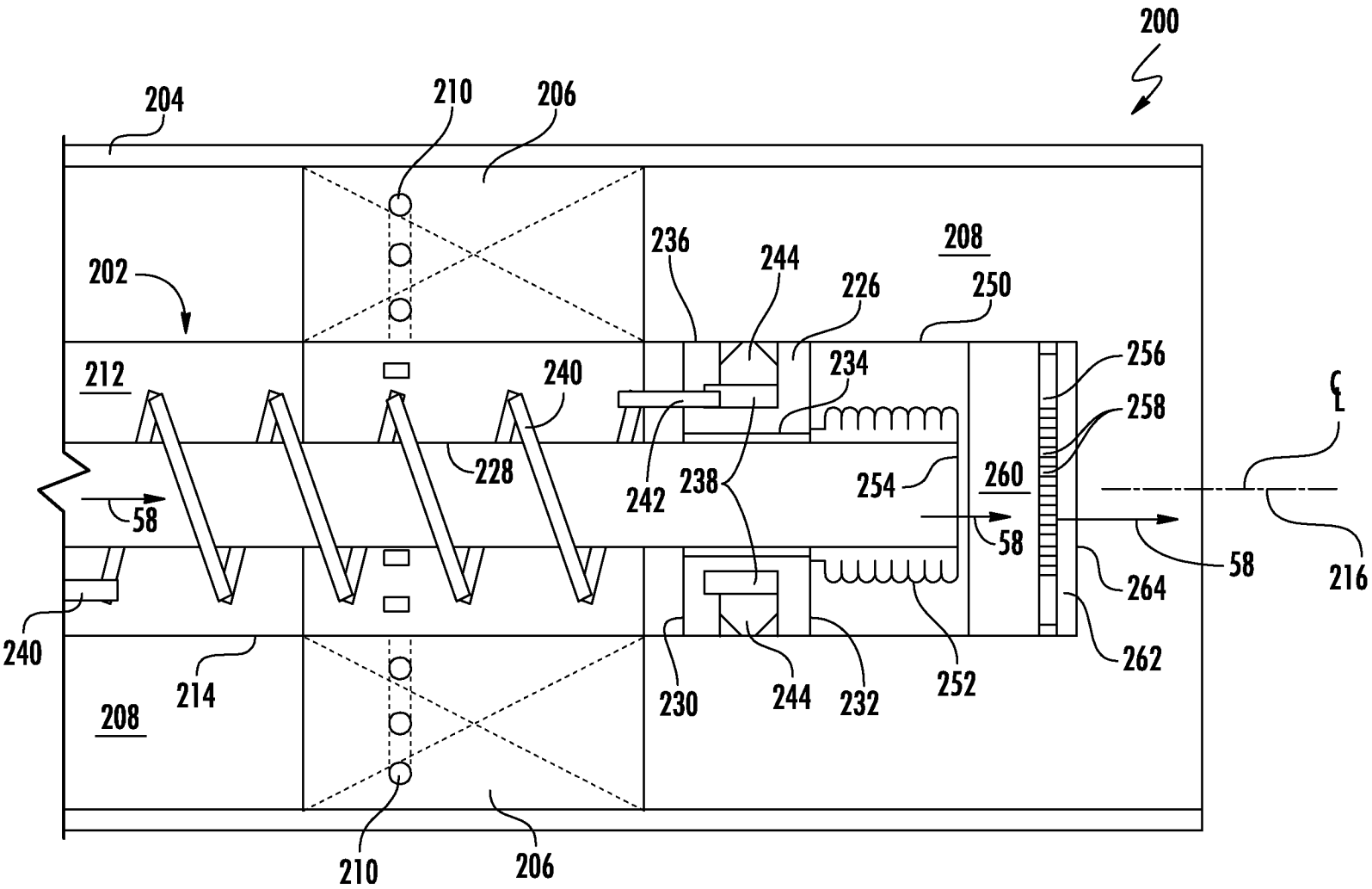
FIG. 5 is an enlarged cross-sectioned side view of a portion of the exemplary center fuel nozzle shown in FIG. 4.
Figure 6:
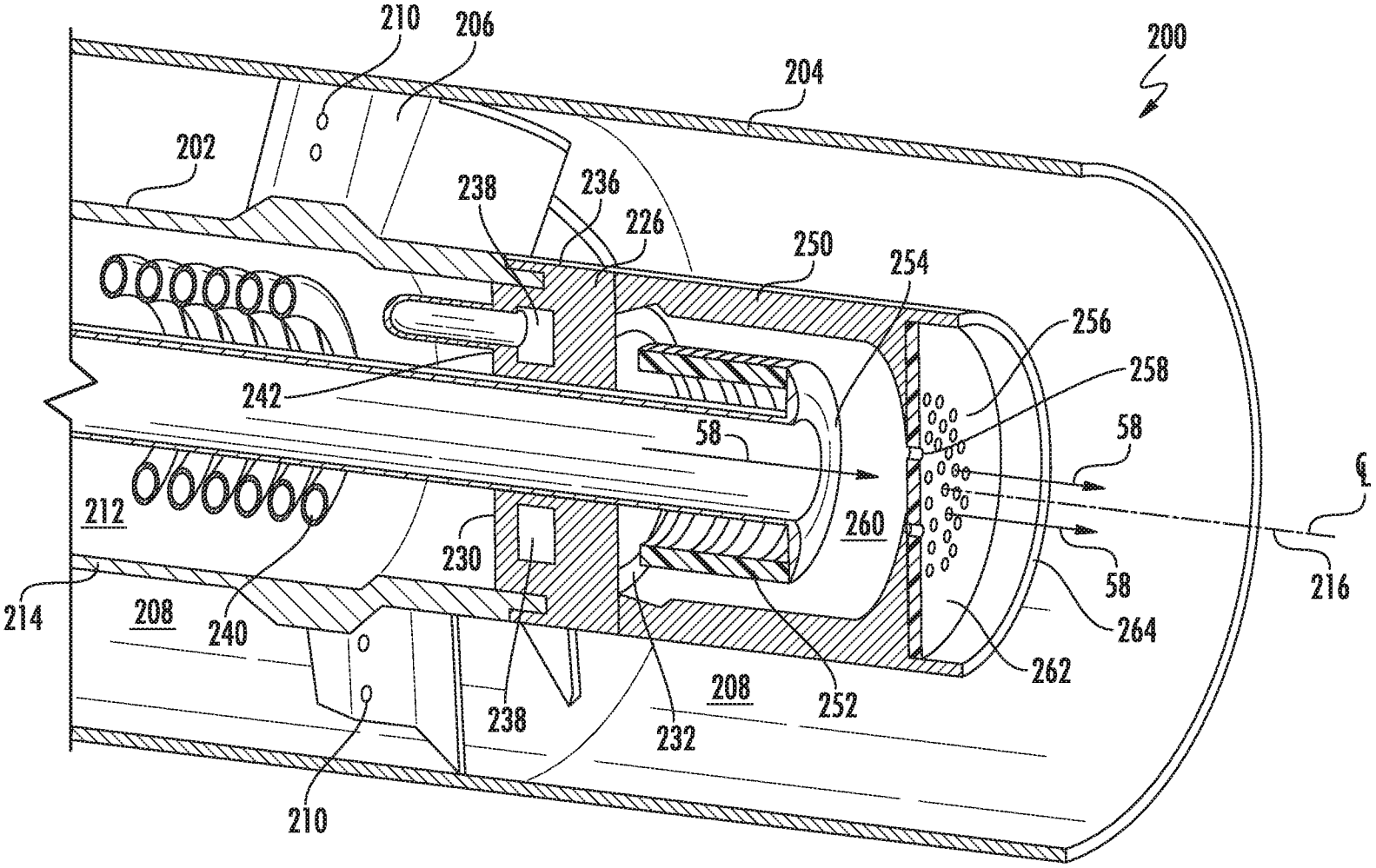
FIG. 6 is an enlarged cross-sectioned perspective view of a portion of the center fuel nozzle shown in FIG. 4, according to at least one embodiment of the present disclosure.

FIG. 4 provides a cross-sectioned side view of an exemplary center fuel nozzle 200 with pre-mix and dual-fuel capabilities according to at least one embodiment of the present disclosure. FIG. 5 provides an enlarged cross-sectioned view of a portion of the center fuel nozzle shown in FIG. 3 according to at least one embodiment of the present disclosure. FIG. 6 provides an enlarged cross-sectioned perspective view of a portion of the center fuel nozzle 200 shown in FIG. 4, according to at least one embodiment of the present disclosure.

As shown in FIGS. 4, 5, and 6 collectively, the center fuel nozzle 200 includes a center body 202 having an annular or tube shape. In particular embodiments, the center fuel nozzle 200 may include a burner tube 204 that extends circumferentially around at least a portion of the center body 202 and a plurality of turning vanes 206 that extend between the center body 202 and the burner tube 204. The turning vanes 206 are disposed within an annular or premix passage 208, which is defined radially between the center body 202 and the burner tube 204. In particular embodiments, one or more of the turning vanes 206 includes a respective fuel port 210, which is in fluid communication with a gas fuel plenum 212 defined within the center body 202. The gas fuel plenum 212 is fluidly coupled to a gas fuel supply 50 (FIG. 4) to receive a gas fuel 52 therefrom.

The center body 202 may be formed from one or more sleeves or tubes 214 coaxially aligned with a longitudinal axis or axial centerline 216 of the center fuel nozzle 200. The axial centerline 216 of the center fuel nozzle 200 is coincident with an axial centerline through the end cover 40. The center fuel nozzle 200 may be connected to an inner surface of the end cover 40 via mechanical fasteners or by other connecting means (not shown). In particular embodiments, as shown in FIG. 4, an upstream end portion 218 of the burner tube 204 may at least partially define an inlet 220 to the premix passage 208, and a downstream end portion 222 of the burner tube 204 may at least partially define an outlet 224 of the premix passage 208. In at least one embodiment, the inlet 220 is in fluid communication with the head end volume 42 (FIG. 2) of the combustor 18.

In various embodiments, as shown in FIGS. 4 through 6 collectively, the center fuel nozzle 200 includes a ring manifold 226 and an inner tube 228 that extends axially and/or coaxially through the ring manifold 226 with respect to the centerline 216. The gas fuel plenum 212 is defined radially between the inner tube 228 and the one or more tubes 214 of the center body 202.

As shown in FIGS. 5 and 6, the ring manifold 226 includes a forward side wall 230 that is axially spaced from an aft side wall 232 with respect to axial centerline 216. The ring manifold 226 comprises an inner band 234 that is radially spaced from an outer band 236 with respect to axial centerline 216. A fuel plenum 238 is defined within the ring manifold 226 between the inner band 234, the outer band 236, the forward side wall 230, and the aft side wall 232.

The inner band 234 of the ring manifold 226 is detached from the inner tube 228. Rather, the outer band 236 of the ring manifold 226 is attached to the center body 202 and an outer sleeve 250, as discussed further herein. Thus, in particular embodiments, the inner tube 228 is thermally decoupled from the ring manifold 226, such that the inner tube 228 is unrestrained in its thermal growth or movement through the ring manifold 226.

In particular embodiments, as detailed in FIGS. 4 through 6 collectively, the fuel plenum 238 is fluidly coupled to a liquid fuel supply 54 via a fuel tube 240. The fuel tube 240 extends helically within the center body 202 upstream of the forward side wall 230 of the ring manifold 226 and is disposed within the gas fuel plenum 212. In particular embodiments, the fuel tube 240 extends helically about a portion the inner tube 228 upstream of the forward side wall 230 of the ring manifold 226. An aft end 242 of the fuel tube 240 may be connected to the forward side wall 230 and fluidly coupled to the fuel plenum 238 of the ring manifold 226.

Figure 7:
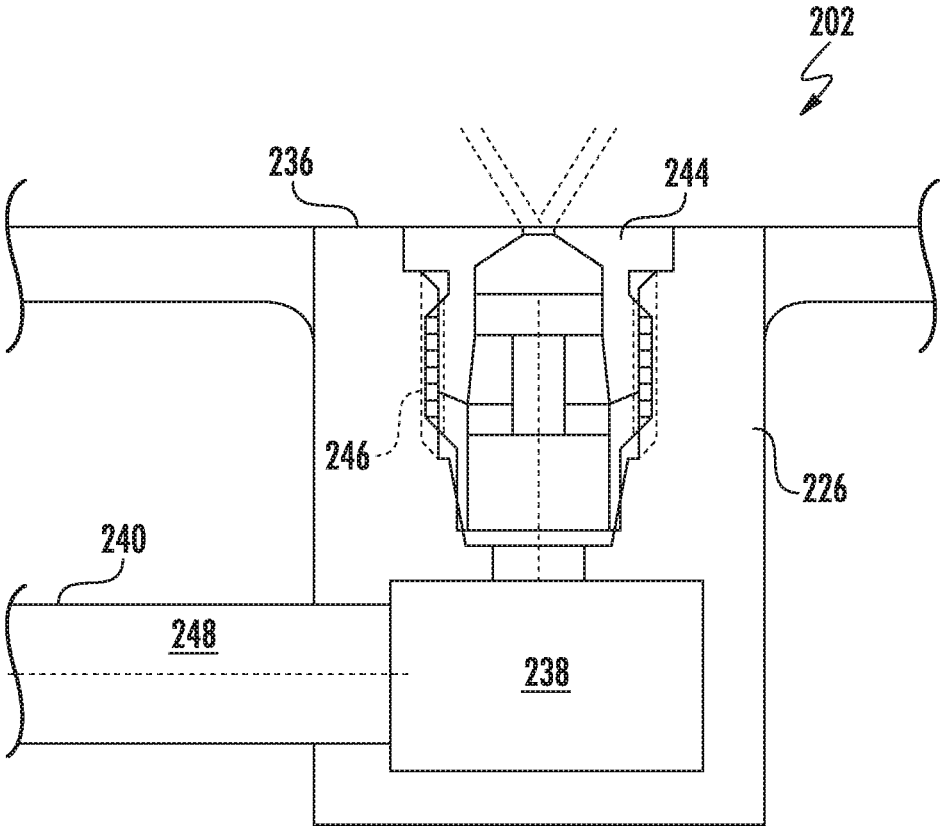
FIG. 7 is an enlarged cross-sectioned side view of a portion of the center fuel nozzle shown in FIG. 4, according to at least one embodiment of the present disclosure.

FIG. 7 provides an enlarged cross-sectioned side view of a portion the center body 202, according to at least one embodiment of the present disclosure. In particular embodiments, as shown in FIGS. 4, 5, and 7 collectively, a plurality of fuel injectors 244 is circumferentially spaced about or within the outer band 236, each of which is in fluid communication with the fuel plenum 238. Each fuel injector 244 of the plurality of fuel injectors 244 is radially oriented to inject an atomized jet of liquid fuel into the premix passage 208 at a location that is downstream from the turning vanes 206 and/or the fuel ports 210. The atomized jet of liquid fuel is directed in a generally radial direction from the fuel injectors 244, relative to the axial centerline 216.

In particular embodiments, as detailed in FIG. 7, one or more of the radial fuel injectors 244 may be screwed into, threaded into, or otherwise removably attached within a corresponding opening 246 of the ring manifold 226. The fuel tube 240 provides or defines a fluid passage 248 for passing a liquid fuel 56 from the liquid fuel supply 54 to the fuel plenum 238.

In particular embodiments, as shown in FIGS. 4, 5, and 6, the center body further comprises an outer sleeve 250. The outer sleeve 250, which may be connected to the outer band 236 of the ring manifold 226, extends aft of the aft side wall 232 of the ring manifold 226. In particular embodiments, as shown in FIGS. 4, 5, and 6, a flexible seal 252 (such as a bellows seal) circumferentially surrounds a portion of the inner tube 228 that is disposed aft of the aft side wall 232 within the outer sleeve 250. The flexible seal 252 connects an aft end 254 of the inner tube 228 to the aft side wall 232 of the ring manifold 226. The flexible seal 252 forms a seal around a portion of the inner tube 228 between the aft end 254 of the inner tube 228 and the aft side wall 232 of the ring manifold 226.

In particular embodiments, as shown in FIGS. 5 and 6, a nozzle body or disk 256 is disposed within the outer sleeve 250 downstream from the aft end 254 of the inner tube 228. The nozzle body 256 extends radially and circumferentially within the outer sleeve 250 with respect to axial centerline 216. The nozzle body 256 defines a plurality of apertures 258. The aft side wall 232 of the ring manifold 226, the outer sleeve 250, the flexible seal 252, and the nozzle body 256 collectively define a fluid chamber 260 within the outer sleeve 250. The plurality of apertures 258 is in fluid communication with the fluid chamber 260. In particular embodiments, an aft face 262 of the nozzle body 256 may be axially offset (axially inwardly) from an aft end 264 of the outer sleeve 250.

In premixed gas fuel operating mode, as illustrated collectively in FIGS. 4, 5 and 6, gas fuel 52 flows from the gas fuel supply 50 and into the gas fuel plenum 212. The gas fuel 52 exits the gas fuel plenum 212 via the fuel ports 210 and is injected into a stream of the compressed air 28 originating from the head end volume 42 and flowing through the premix passage 208, thus forming a premixed gas fuel-air mixture. Air or other diluent 58 from a diluent supply 60 (FIG. 4) is routed though the inner tube 228, into the fluid chamber 260, and through the apertures 258 of the nozzle body 256. The diluent supply 60 may be compressed air 58 from the head end chamber 42 or may be a compressed fluid from another source. The air 58 (or other diluent) provides cooling to the nozzle body 256 while also mitigating/stabilizing combustion dynamics within the combustion chamber 46.

During premixed liquid fuel operation, liquid fuel 56 from the liquid fuel supply 54 is supplied to the fuel plenum 238 of the ring manifold 226 via the fuel tube 240. The fuel injectors 244 atomize the liquid fuel into the premix passage 208 downstream of the turning vanes 206 and direct the liquid fuel into the stream of the compressed air 28 flowing through the premix passage 208. Air or other diluent 58 from the diluent supply 60 (FIG. 4) is routed though the inner tube 228, into the fluid chamber 260, and through the apertures 258 of the nozzle body 256. The air 58 (or other diluent) provides cooling to the nozzle body 256 while also mitigating/stabilizing combustion dynamics within the combustion chamber 46.

In both premixed liquid fuel operation and premixed gas fuel operation, the flexible seal 252 and the helical fuel tube 240 allow for relative thermal growth between the various hardware components of the center body 202, such as between the inner tube 228, the ring manifold 226 and the center body 202.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel nozzle, comprising:

a center body having a tube shape;

a ring manifold disposed at an aft end of the center body;

an inner tube extending axially through the ring manifold and disposed within the center body, the inner tube being in fluid communication with a diluent supply, the inner tube and the ring manifold at least partially defining a gas plenum within the center body;

an outer sleeve connected to the ring manifold and extending axially from the ring manifold to an aft end;

a nozzle body disposed within the outer sleeve, the nozzle body comprising an aft face that is disposed axially inward from the aft end of the outer sleeve, wherein an aft end of the inner tube is disposed within the outer sleeve and spaced apart from the nozzle body such that an axial gap is defined therebetween;

a fuel tube extending helically around a portion of the inner tube, the fuel tube fluidly coupling a fuel plenum of the ring manifold to a liquid fuel supply;

a plurality of fuel injectors circumferentially spaced within an outer band of the ring manifold and in fluid communication with the fuel plenum, each fuel injector of the plurality of fuel injectors being oriented to direct a flow of atomized liquid fuel radially outward from the center body;

a flexible seal disposed within the outer sleeve and circumferentially surrounding a portion of the inner tube, wherein the flexible seal extends between an aft side wall of the ring manifold and the aft end of the inner tube;

a fluid chamber, defined collectively by the aft side wall of the ring manifold, the outer sleeve, the flexible seal, and the nozzle body, that receives a diluent from the inner tube; and wherein the ring manifold is unrestrained relative to the inner tube.

2. The fuel nozzle of claim 1, wherein one or more fuel injectors of the plurality of fuel injectors is removably inserted into the ring manifold.

3. The fuel nozzle as in claim 1, further comprising a plurality of turning vanes that extends radially outward from the center body, each turning vane including at least one fuel port, wherein a gas fuel plenum is in fluid communication with a gas fuel supply and each fuel port is in fluid communication with the gas fuel plenum.

4. The fuel nozzle as in claim 1, wherein an aft end of the fuel tube is connected to a forward side wall of the ring manifold.

5. The fuel nozzle of claim 1, wherein the nozzle body is disposed downstream from the aft end of the inner tube, wherein the nozzle body defines a plurality of apertures.

6. The fuel nozzle as in claim 5, wherein the plurality of apertures is in fluid communication with the fluid chamber.

7. The fuel nozzle as in claim 1, wherein the flexible seal is axially spaced apart from both the nozzle body and radially spaced apart from the outer sleeve such that the fluid chamber surrounds the flexible seal within the outer sleeve.

8. The fuel nozzle as in claim 7, wherein the flexible seal is a bellows.

9. A combustor, comprising:

an end cover; and a center fuel nozzle disposed along an axial centerline of the end cover, the center fuel nozzle comprising:

a center body having a tube shape;

a ring manifold disposed at an aft end of the center body;

an inner tube extending axially through the ring manifold and disposed within the center body, the inner tube being in fluid communication with a diluent supply, the inner tube and the ring manifold at least partially defining a gas plenum within the center body;

an outer sleeve connected to the ring manifold and extending axially from the ring manifold to an aft end;

a nozzle body disposed within the outer sleeve, the nozzle body comprising an aft face that is disposed axially inward from the aft end of the outer sleeve, wherein an aft end of the inner tube is disposed within the outer sleeve and spaced apart from the nozzle body such that an axial gap is defined therebetween;

a fuel tube extending helically around a portion of the inner tube, the fuel tube fluidly coupling a fuel plenum of the ring manifold to a liquid fuel supply;

a plurality of fuel injectors circumferentially spaced within an outer band of the ring manifold and in fluid communication with the fuel plenum, each fuel injector of the plurality of fuel injectors being oriented to direct a flow of atomized liquid fuel radially outward from the center body; a flexible seal disposed within the outer sleeve and circumferentially surrounding a portion of the inner tube, wherein the flexible seal extends between an aft side wall of the ring manifold and the aft end of the inner tube;

a fluid chamber defined collectively by the aft side wall of the ring manifold, the outer sleeve, the flexible seal, and the nozzle body, that receives a diluent from the inner tube; and wherein the ring manifold is unrestrained relative to the inner tube.

10. The combustor of claim 9, wherein one or more fuel injectors of the plurality of fuel injectors are removably inserted into the ring manifold.

11. The combustor as in claim 9, further comprising a plurality of turning vanes that extends radially outward from the center body, each turning vane including at least one fuel port, wherein a gas fuel plenum is in fluid communication with a gas fuel supply and each fuel port is in fluid communication with the gas fuel plenum.

12. The combustor as in claim 9, wherein an aft end of the fuel tube is connected to a forward side wall of the ring manifold.

13. The combustor of claim 9, wherein the nozzle body is disposed within the outer sleeve downstream from the aft end of the inner tube, and wherein the nozzle body defines a plurality of apertures.

14. The fuel nozzle as in claim 1, wherein the inner tube axially terminates at the aft end of the inner tube, wherein the aft end of the inner tube extends radially outward from an outer surface of the inner tube, and wherein the flexible seal extends axially between the aft end of the inner tube and the aft side wall of the ring manifold such that the flexible seal is radially spaced apart from the outer surface of the inner tube.

15. The fuel nozzle as in claim 1, wherein the fluid chamber is only in fluid communication with the inner tube and the nozzle body.

16. The fuel nozzle as in claim 1, wherein the fluid chamber is defined only by the aft side wall of the ring manifold, the outer sleeve, the flexible seal, and the nozzle body.

* * * * *